United States Patent [19]

Oropallo

[11] 4,123,810

[45] Nov. 7, 1978

[54] DRAIN AND REMOVABLE GOOSENECK STRUCTURE

[75] Inventor: Robert A. Oropallo, Los Angeles, Calif.

[73] Assignee: American Brass & Aluminum Foundry Co., Inc., Los Angeles, Calif.

[21] Appl. No.: 796,976

[22] Filed: May 16, 1977

Related U.S. Application Data

[63] Continuation-in-part of Ser. No. 749,827, Dec. 13, 1976, Pat. No. 4,092,745.

[51] Int. Cl.[2] ..... E03C 1/26

[52] U.S. Cl. ..... 4/288; 4/292

[58] Field of Search ..... 4/145, 146, 189–191, 4/286–288, 292, 208; 137/362; 210/163, 164, 166; 220/42 B, 42 C; 248/42, 161, 238, 205, 58

[56] References Cited

U.S. PATENT DOCUMENTS

| | | | |
|---|---|---|---|
| 2,077,516 | 4/1937 | Dart | 4/286 |
| 2,161,783 | 6/1939 | Hubar | 4/286 |
| 2,349,202 | 5/1944 | Slazak | 4/288 |
| 3,420,552 | 1/1969 | Monk | 4/288 X |
| 3,438,066 | 4/1969 | Morris | 4/288 |
| 3,579,670 | 5/1971 | Frank | 4/252 R |
| 3,742,525 | 7/1973 | Oropallo | 4/288 |

*Primary Examiner*—Henry K. Artis

*Attorney, Agent, or Firm*—William W. Haefliger

[57] ABSTRACT

A drain assembly has a downwardly projecting threaded stem, and in combination with the assembly there are:

(a) a tube having an upwardly opening bore below the stem, (b) an annular part having a skirt adjustably fitting said bore to be bonded thereto at selected elevation and penetration into the bore, and (c) a nut relatively rotatably interfitting said part and retained thereto, said part having an annular portion projecting upwardly and telescopically relative to the nut, (d) the nut telescopically interfitting the stem and having threaded connection therewith, whereby upward tightening of the nut on the stem operates to energize a seal between said part annular portion and said stem, and said nut is disconnectible from the stem to enable cleaning of the interior of the nut, part and tube.

9 Claims, 9 Drawing Figures

DRAIN AND REMOVABLE GOOSENECK STRUCTURE

BACKGROUND OF THE INVENTION

This application is a continuation-in-part of my earlier application Ser. No. 749,827 filed Dec. 13, 1976 for "DRAIN FITTING" and now U.S. Pat. No. 4,092,745.

This invention relates generally to flow drain installations, and more particularly concerns plastic drains which are adjustable and suitable for many different purposes.

It has long been customary to install brass drains in shower stalls. Such installation is time consuming and expensive due to cost of brass metal and to the time consumed in preparing and applying lead waste to the joint as packing between the fitting and drain pipe. An advanced type plastic drain for use in shower stalls is described in my U.S. Pat. No. 3,742,525.

The present invention enables simple and easy cleaning of installed plastic drains, particularly facilitating their use and application in motor homes and recreational vehicles as well as other applications. Quick installation of such drains is also facilitated by their improved construction.

SUMMARY OF THE INVENTION

It is a major object of the invention to provide an advanced type drain assembly suitable for general usage in a wide variety of applications, and especially including recreational vehicles and motor homes, through enablement of quick and easy assembly and disassembly. Basically, the drain assembly comprises:

(a) a tube having an upwardly opening bore below the stem, (b) an annular part having a skirt adjustably fitting said bore to be bonded thereto at selected elevation and penetration into the bore, and (c) a nut relatively rotatably interfitting said part and retained thereto, said part having an annular portion projecting upwardly and telescopically relative to the nut, (d) the nut telescopically interfitting the stem and having threaded connection therewith, whereby upward tightening of the nut on the stem operates to energize a seal between said part annular portion and said stem, and said nut is disconnectible from the stem to enable cleaning of the interior of the nut, part and tube.

The nut may be removed from the stem without rotating the annular part, displacing the latter downwardly to free the nut from the stem to facilitate cleaning of the drain.

As will appear, the annular portion of the part may project upwardly in the nut, the latter having an inturned flange rotatably received in a recess formed by the part annular portion below the threaded connection of the nut and stem. In addition, the assembly may advantageously include a tubular plastic body integral with and located above the stem, the body sized to exteriorly fit a drain floor opening, the body having a second thread spaced above the level of the first mentioned threaded connection, and a second nut threadably engaging the second thread and rotatable relative to the body to effect a clamp to the drain floor. As mentioned above, the drain floor may be located in a mobile home or recreational vehicle, and the elements of the drain assembly typically consist of molded plastic material.

These and other objects and advantages of the invention, as well as the details of an illustrative embodiment, will be more fully understood from the following description and drawings, in which:

DRAWING DESCRIPTION

DETAILED DESCRIPTION

Figure 1:
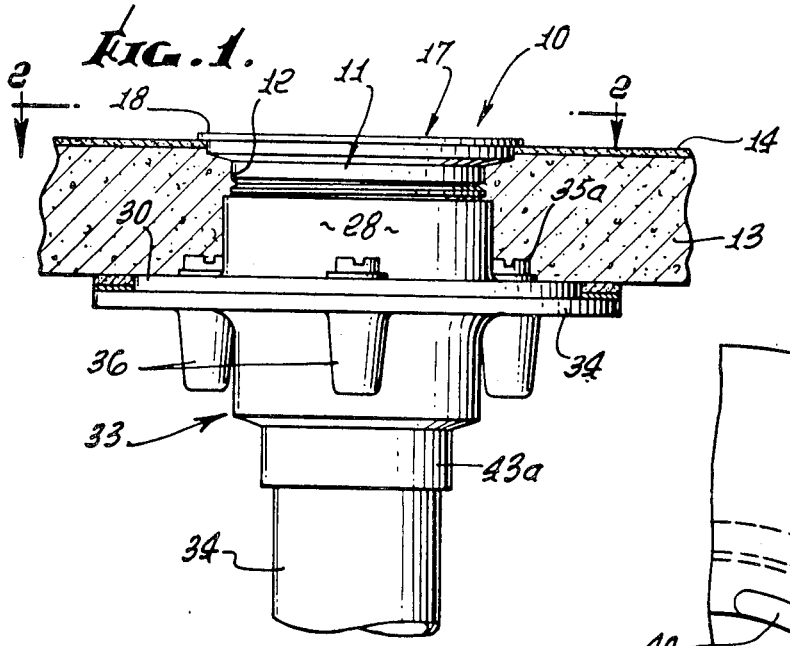
FIG. 1 is an elevation.
Figure 4:
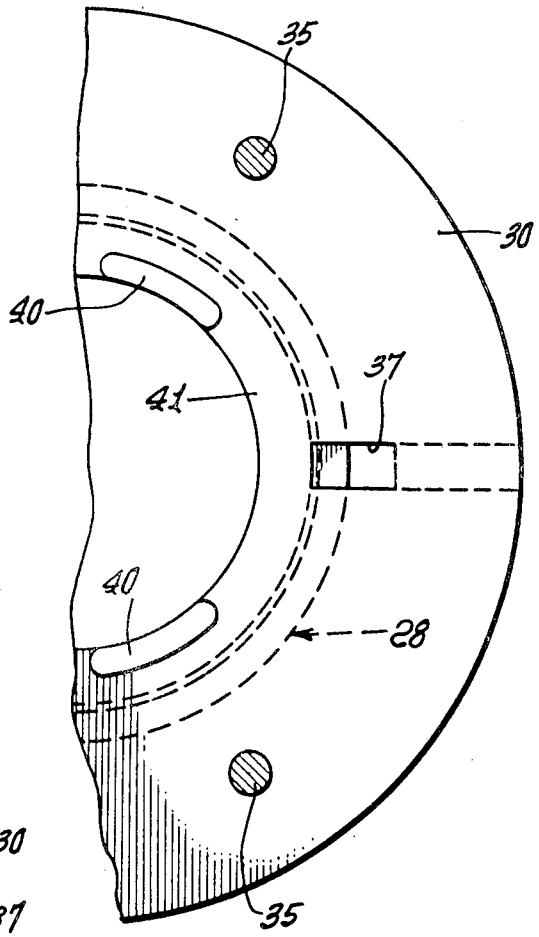
FIG. 4 is a fragmentary section, taken on lines 4—4 of FIG. 3.
Figure 2:
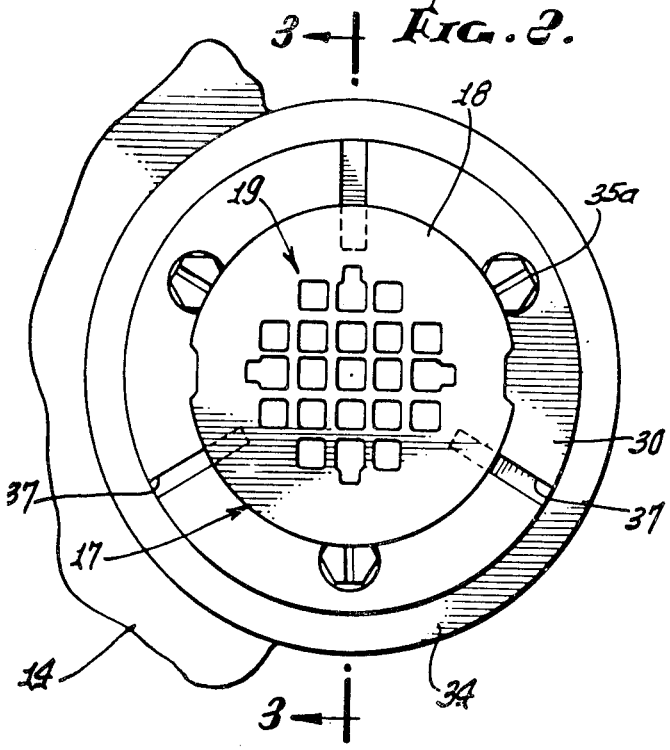
FIG. 2 is a plan view in lines 2—2 of FIG. 1.

In FIGS. 1-4, the drain assembly 10 includes a tubular plastic body 11 sized to exteriorly fit an opening 12 in a drain floor. The latter may include a layer of cement or concrete 13, or other poured material, and an upper tile layer 14. An outer flange 15 integral with the body 11 overhangs body exterior threading 16.

A plate 17 defines an upper flange 18 overlapping the top of body 11, including flange 15. The plate includes a grille 19 bounded by flange 17 and overlying the upper interior of the body. The plate also provides a depending cylindrical portion 20 downwardly rearwardly received in a counterbore 21 defined by the body, and the lower rim 24 of cylindrical portion 20 may seat on a ledge or shoulder 22 that is formed between body counterbore 21 and bore 23. Detent means is formed by the portion 20 and the body to releasably retain the plate in position at the top of the body. Such detent means may include an annular protrusion 26 on the portion 20, and an annular recess 27 in the body. The protrusion snapping into the recess upon full reception of the plate portion 20 into the counterbore.

A nut 28 has internal threading 29 threadably engaging the body thread 16, whereby the nut is rotatable relative to the body while engaged thereto. The nut defines an external wide flange 30 which extends annularly beneath the cement flooring 13, and rotation of the nut on the body adjusts the flange to the underside of the flooring 13 provided or to be provided (as by pouring of the cement, concrete or other flowable and hardenable material about the nut and body). The nut and body may advantageously consist of molded ABS, PVC, or other plastic material, the high cost of metal being obviated.

A tubular base 33 is provided to simply, rapidly and most advantageously couple drain pipe 34 to the relatively adjustable body and nut. The base 23 also includes a wide flange 34 removably attached to the nut flange 30, as by fasteners 35. For this purpose, the plastic base may have integral projections 36 depending from the flange 34 and forming interior threading 37. The fastener heads **35*a* are therefore located above flange 30, to be retained, against loosening, by the poured and hardened material 13; however, they may initially be tightened from above since they are located generally outside a cylinder defined by the outermost edge of flange 15. Sealant paper or other layered material 136 is located between and clamped by the flanges 30 and 34**.

The nut 28 defines at least one weep hole 137 and preferably several circularly spaced about axis 38, the hole or holes extending through the side wall of the nut at the level of flange 30 to communicate between the exterior and upper interior 39 of the tubular base. Accordingly, trapped air may escape to interior 39 as cement 13 is poured in place. The nut also includes circularly spaced, downward projections 40 extending into the upper interior 39 of the base, the weep holes located between such projections. Projections extend downwardly from and interior flange 41 defined by the nut, and act as centering guides and stiffeners. Bore 42 of the base tubular portion 43 lies closely adjacent the projections 40.

Figure 3:
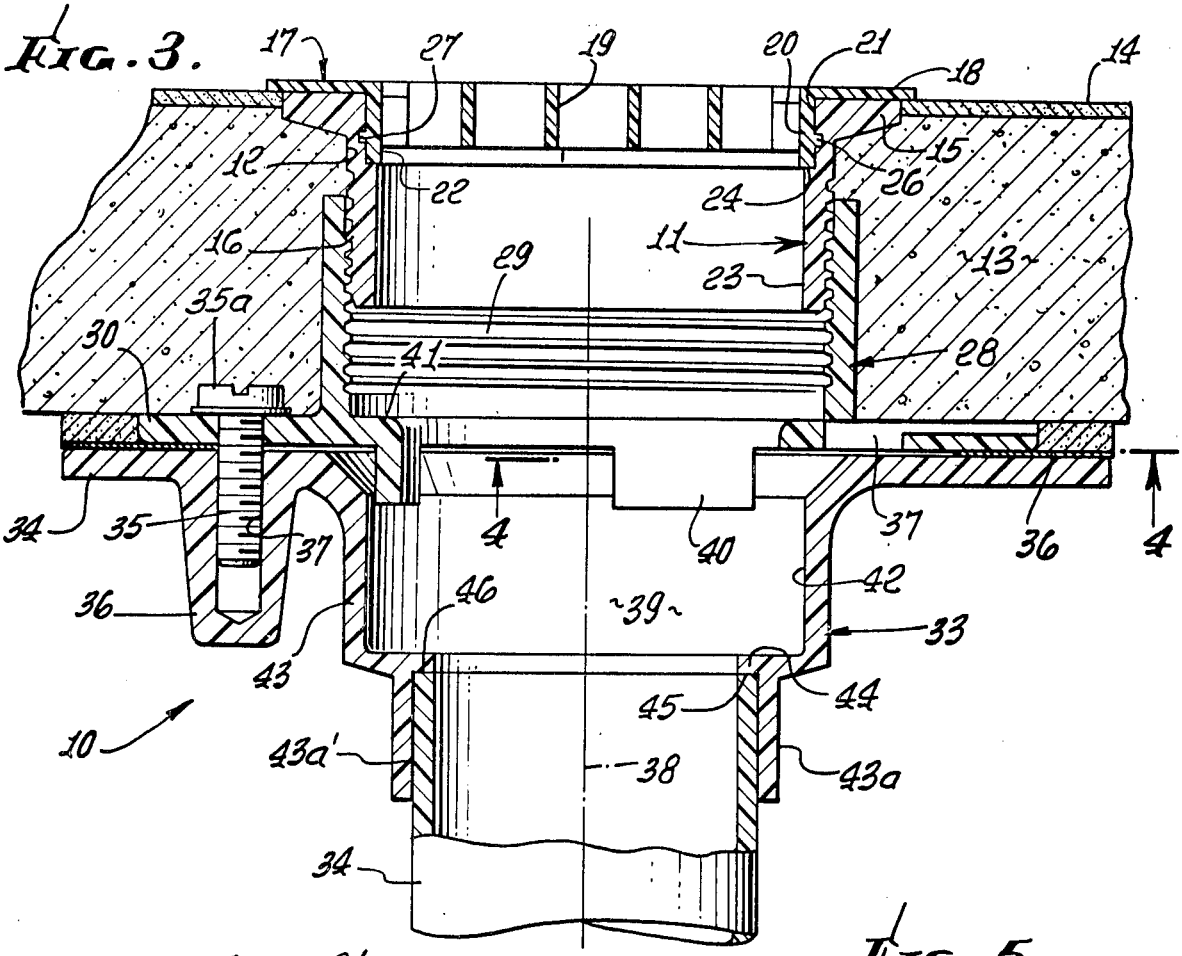
FIG. 3 is an enlarged elevation, taken in section on lines 3—3 of FIG. 2.

In the form of the device shown in FIG. 3, the tubular portion 43 defines a radially inwardly projecting annular flange 44 forming a downwardly facing stop shoulder 45 to limit the uppermost end extent 46 of pipe 34. Note that the pipe is closely received by a downward extension **43*a* of the portion 43, whereby the pipe may be bonded to the bore 43*a*'. In this regard, the base 33 may also consist of molded plastic material (such as ABS or PVC), the pipe itself may consist of molded plastic, and glue may be used to sealingly adhere the pipe to bore 43*a***.

Figure 5:
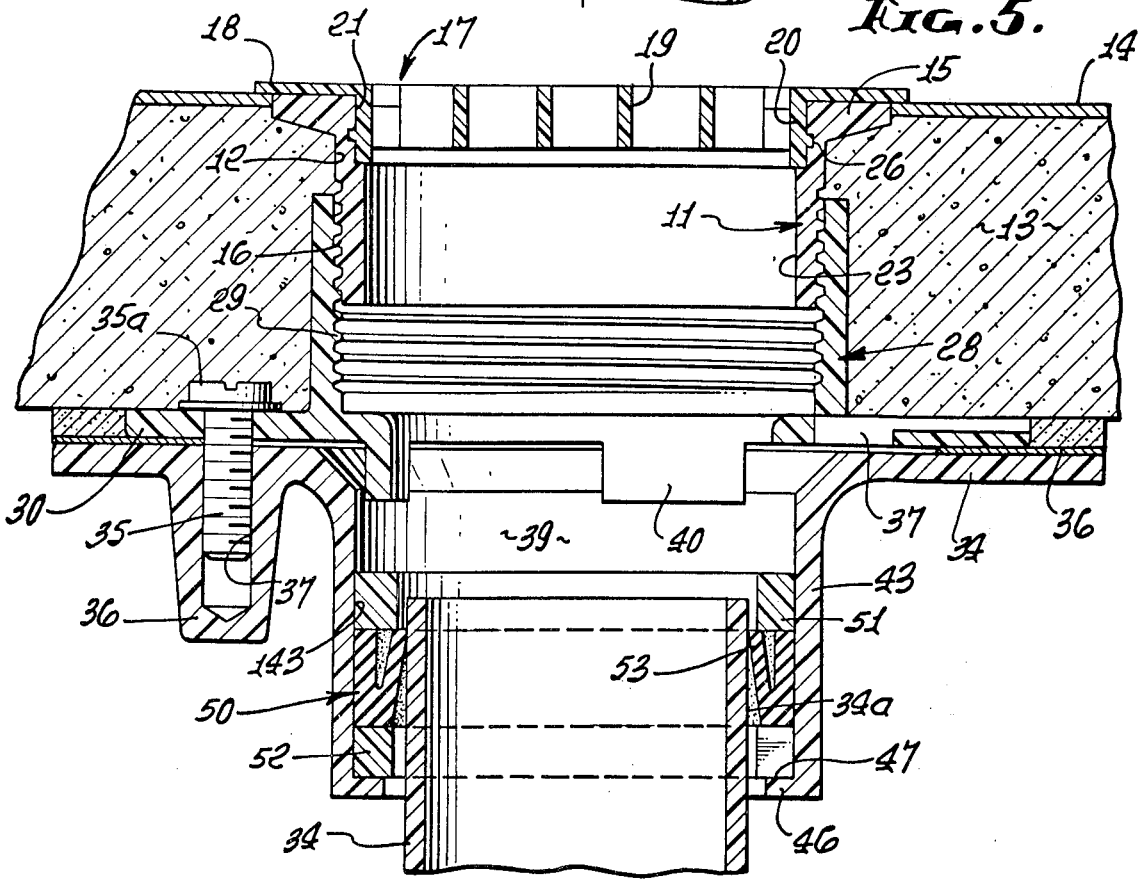
FIG. 5 is a view like FIG. 3, but showing a modification.

In FIG. 5, the elements remain the same as in FIG. 3, retain the same identifying numbers. In this modification, the base tubular portion 43 has a radially inwardly projecting bottom lip 46 defining an upwardly facing shoulder or ledge 47. Also, annular means is provided and suspended on ledge 47 for sealing off between the tubular portion 43 and the upper extent 34 of the pipe received therein. Such means may advantageously comprise an annular elastomeric seal 50, and seal retainer rings 51 and 52 located above and below the seal. The seal 50 is shown as including annular, flexible lip 53 projecting upwardly and inwardly to compressively engage and seal off against the pipe exterior surface **34*a*. Accordingly, the FIG. 3 construction may be considered as self-caulked. The plastic rings 51 and 52 may be suitably bonded to the bore 143 of the plastic tubular portion, to retain the elastomeric seal in fixed position in the tubular portion 43**.

Figure 6:
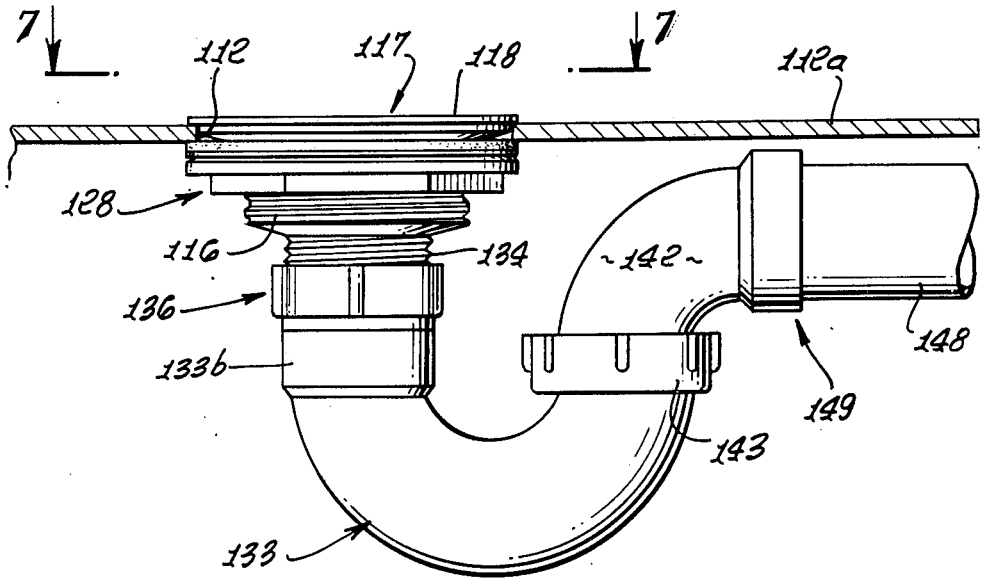
FIG. 6 is a vertical elevation showing another drain fitting assembly.
Figure 7:
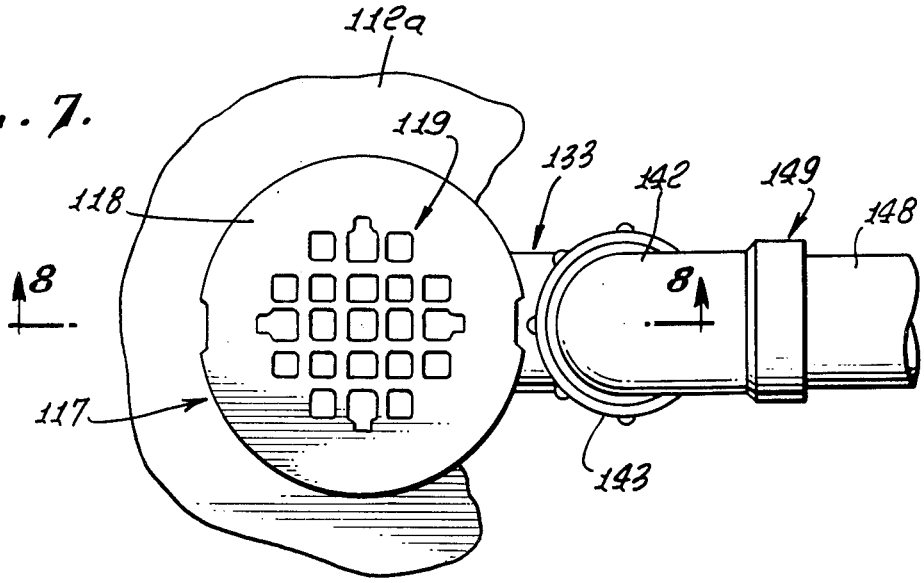
FIG. 7 is a plan view on lines 7—7 of FIG. 6.
Figure 8:
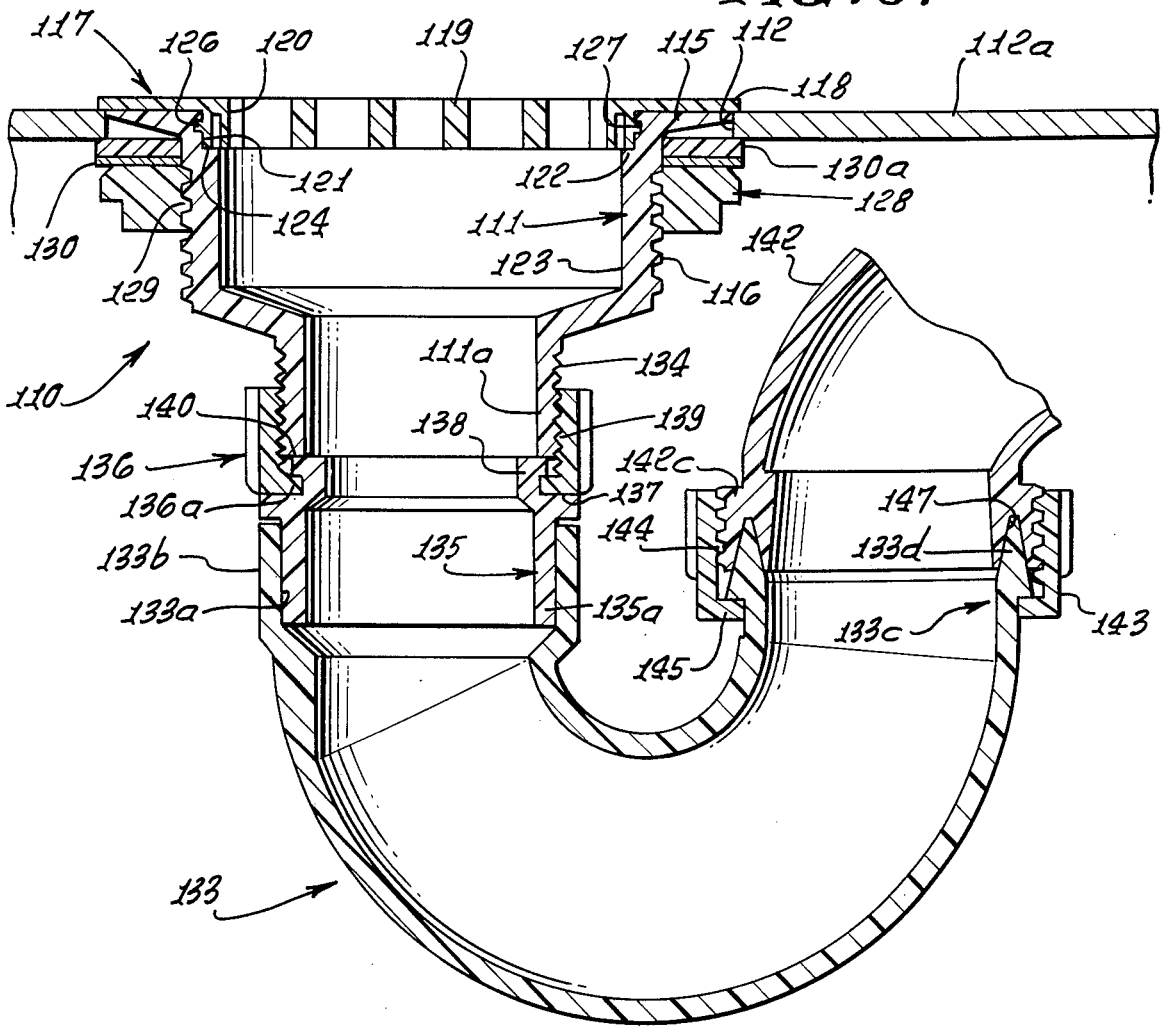
FIG. 8 is an enlarged section on lines 8—8 of FIG. 7.

In FIGS. 6–8, the drain fitting assembly 110 includes a tubular plastic body 111 sized to exteriorly fit an opening 112 in a drain floor **112*a*. The latter may consist of molded glass fibers and resin, and be located in a mobile home or recreational vehicle. An outer flange 115 integral with the body 111 overhangs body exterior theading 116**.

A plate 117 defines an upper flange 118 overlapping the top of body 111, including flange 115. The plate includes a grille 119 bounded by flange 117 and overlying the upper interior of the body. The plate also provides a depending cylindrical portion 120 downwardly rearwardly received in a counterbore 121 defined by the body, and the lower rim 124 of cylindrical portion 120 may seat on a ledge or shoulder 122 that is formed between body counterbore 121 and bore 123. Detent means is formed by the portion 120 and the body to releasably retain the plate in position at the top of the body. Such detent means may include an annular protrusion 126 on the portion 120, and an annular recess 127 in the body. The protrusion snaps into the recess upon full reception of the plate portion 120 into the counterbore.

A first nut 128 has internal threading 129 threadably engaging the body thread 116, whereby the nut is rotatable relative to the body while engaged thereto. The nut lies beneath annular elements 130 and **130*a*, and rotation of the nut on the body clamps such elements to the underside of the drain floor 112*a*. The nut 128 body 111 and part 130*a* may advantageously consist of molded ABS, PVC, or other plastic material, the high cost of metal being obviated. Element 130** may consist of a gasket.

Located below the body 111 is a tube, shown in the form of a gooseneck or turn 133 having an upwardly opening bore **133*a*. The latter is spaced below a diametrically reduced stem 111*a* integral with body 111, and forming an external thread indicated at 134. In accordance with an important aspect of the invention, an annular part 135 is located between tube 133 and stem 111*a*, and has a skirt 135*a* vertically adjustable in and fitting the bore 133*a*, to be bonded to the latter at selected elevation and penetration into bore 133*a*. Such interfit may be reversed, i.e. with skirt 135*a* encompassing the upper portion 133*b*** of the tube, the connection being telescopic.

A second nut 136 is provided to rotatably interfit the part 135, as for example by means of nut in-turned flange **136*a* rotatably received in the annular recess 137 formed by the part 135, so that part 135 and the nut 136 are axially retained in assembled condition. Part 135 also has an annular portion 138** projecting upwardly and telescopically relative to the nut, as for example within the latter.

The nut 136 telescopically interfits the stem **111*a*, and has threaded connection to same, as for example by means of nut internal threading 139 meshing with stem external thread 134. Upward tightening of the nut on the stem operates to energize a seal between the part portion 138 and the stem, as for example the clamped together surfaces of these elements at 140. A gasket may alternatively be located at 140. Also, the nut is disconnectible from the stem to enable cleaning of the interiors of the nut, part, tube 133 and stem 111*a*. During such loosening of the nut, part 135 does not rotate, but moves downwardly with turn 133. Such construction is especially important in environments such as mobile home and recreational vehicle drains and showers, where simple, rapid and neat installation after clean-out is required or desired. Further, nut 128 may then be removed from body 111** to permit its removal from the drain floor.

FIGS. 6 and 8 also show a second gooseneck or turn or elbow 142 connected in series to the upward facing end **133*c* of the first turn 133, as via a clamp ring 143. The latter has threaded fit at 144 to end 142*c* of turn 142, and provides a shoulder 145 holding a tapered end 133*d* of turn 133 into socket 147 in end 142*c*. A lateral pipe 148 may be suitably connected at 149 to the opposite and sideward facing end of the second turn 142. Gooseneck 133** serves as a trap.

Parts **111*a*, 135, 136, 133, 142, 148 and 143** may all consist of plastic material such as molded ABS or PVC.

Figure 9:
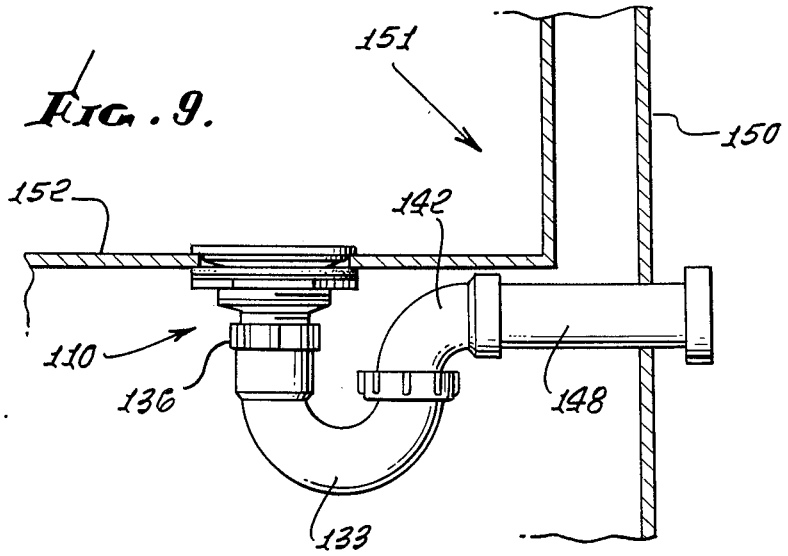
FIG. 9 is a side elevation showing a motor home, and partly broken away to illustrate interior structure.

FIG. 9 shows a mobile home outer wall 150, and a shower stall 151 at the inside of wall 150. The drain structure as described above is connected to the stall bottom wall 152, and pipe 148 discharges through wall 150 to the exterior.

I claim:

1. In combination with a drain assembly having a downwardly projecting threaded stem, the improvement comprising (a) a tube having an upwardly opening bore below the stem, (b) an annular part having a skirt adjustably fitting said bore to be bonded thereto at selected elevation and penetration into the bore, and (c) a nut relatively rotatably interfitting said part and retained thereto, said part having an annular portion projecting upwardly and telescopically relative to the nut, (d) the nut telescopically interfitting the stem and having threaded connection therewith, whereby upward tightening of the nut on the stem operates to energize a seal between said part annular portion and said stem, and said nut is disconnectible from the stem to enable cleaning of the interior of the nut, part and tube, (e) the nut having an in-turned portion spaced above said tube and rotatably received in an annular recess formed by said part annular portion, below said threaded connection of the nut with the stem, said part projecting radially outwardly between the lowermost extent of said nut and an uppermost extent of said tube, and said part projecting radially outwardly between the bottom of the stem and an upper edge defined by said nut in-turned portion, whereby the nut is rotatably captivated by said part.

2. The combination of claim 1 wherein said stem projects downwardly within the nut toward said part annular portion.

3. The combination of claim 1 wherein said part annular portion projects upwardly within the nut.

4. The combination of claim 1 including a tubular plastic body integral with the stem, said body sized to exteriorly fit a drain floor opening, the body having a second thread spaced above the level of said first mentioned threaded connection, and a second nut threadably engaging the second thread and rotatable relative to the body to effect a clamp to the drain floor.

5. The combination of claim 4 including a plate defining an upper flange overlapping the top of the body, and a grille bounded by the upper flange and overlapping the upper interior of the body.

6. The combination of claim 5 wherein said drain floor comprises a floor located in a mobile home or recreational vehicle, said body and nuts consisting of molded plastic material.

7. The combination of claim 1 wherein said part, nut and stem consist of molded plastic material.

8. The combination of claim 1 wherein said tube has the form of a turn, and consists of molded plastic material.

9. The combination of claim 8 including a second plastic tubular turn joined in series with said first mentioned turn, in spaced relation to said part.

* * * * *